US005491490A

United States Patent [19]

Kim et al.

[11] Patent Number: 5,491,490

[45] Date of Patent: Feb. 13, 1996

[54] PHOTON-TRIGGERED RF RADIATOR HAVING DISCRETE ENERGY STORAGE AND ENERGY RADIATION SECTIONS

[75] Inventors: Anderson H. Kim, Toms River; Robert J. Youmans, Brick, both of N.J.; Stephen E. Saddow, Columbia; Louis J. Jasper, Jr., Fulton, both of Md.; Maurice Weiner, Ocean, N.J.

[73] Assignee: The United States of America as represented by the Secretary of the Army, Washington, D.C.

[21] Appl. No.: 344,801

[22] Filed: Nov. 23, 1994

Related U.S. Application Data

[63] Continuation-in-part of Ser. No. 121,656, Sep. 14, 1993, abandoned.

[51] Int. Cl.[6] ..... H01Q 1/36

[52] U.S. Cl. ..... 343/895

[58] Field of Search ..... 343/895; H01Q 1/36, H01Q9/27

[56] References Cited

U.S. PATENT DOCUMENTS

| | | | |
|---|---|---|---|
| 3,241,148 | 3/1966 | Lechtreck | 343/895 |
| 3,956,752 | 5/1976 | Phelan et al. | 343/895 |
| 4,243,993 | 1/1981 | Lamberty et al. | 343/895 |
| 4,319,248 | 3/1982 | Flam | 343/895 X |
| 5,028,971 | 7/1991 | Kim et al. | 357/30 |
| 5,177,486 | 1/1993 | Kim et al. | 342/21 |
| 5,227,621 | 7/1993 | Kim et al. | 250/214.1 |
| 5,283,584 | 2/1994 | Kim et al. | 342/21 |
| 5,351,063 | 9/1994 | Kim et al. | 343/895 |

*Primary Examiner*—Donald T. Hajec
*Assistant Examiner*—Steven Wigmore
*Attorney, Agent, or Firm*—Michael Zelenka; James A. Digiorgio

[57] ABSTRACT

A photon triggered RF radiator having separate sections to perform the energy storage and the energy radiation functions. The energy storage function is performed by at least one charging electrode positioned on the upper surface of a photoconductive dielectric substrate, whereas the energy radiation function is performed by a charging electrode positioned adjacent to the charging electrode on the upper surface of the substrate. The charging electrode and the radiating electrode are separated by a predetermined gap distance that is large enough to insure there is no surface flashover between the electrodes and small enough to insure the efficiency of energy discharge from the charging pad to the spiral antenna is maximized.

2 Claims, 2 Drawing Sheets

PHOTON-TRIGGERED RF RADIATOR HAVING DISCRETE ENERGY STORAGE AND ENERGY RADIATION SECTIONS

GOVERNMENT INTEREST

The invention described herein may be manufactured, used, and licensed by or for the Government of the United States of America for governmental services without the payment to us of any royalty thereon.

NOTICE OF CONTINUATION

This application is a continuation-in-part of application Ser. No. 08/121,656, entitled "Monolithic Photoconductive Spiral Antenna Driven By Quasi-Radial Line," by inventors Anderson H. Kim, Robert J. Youmans, Stephen E. Saddow, Louis J. Jasper, Jr., and Maurice Weiner, Attorney Docket No. CECOM 4908, filed Sep. 14. 1993, now abandoned.

NOTICE OF RELATED DISCLOSURES

The invention described herein is related to the applicants' co-pending application Ser. No. 08/109,541, entitled "Photon Triggered Ultra-Wideband Radiator With Charged Reservoir," filed Aug. 19, 1993, now abandoned and U.S. Pat. No. 5,351,063 entitled "Ultra-Wideband High Power Photon Triggered Frequency Independent Radiator With Equiangular Spiral Antenna, issued to Kim et al. on 27 Sep. 1994.

FIELD OF THE INVENTION

This invention relates generally to the field of impulse driven wideband antennas and more particularly to photon triggered ultra-wideband radiators for use in impulse radar apparatus, active electromagnetic signal jammers, and relatively high power microwave radiating systems.

BACKGROUND OF THE INVENTION

In recent years there has been active research in the area of nanosecond-type pulse generation. Such research has produced devices that utilize high power photoconductive solid state switches coupled to energy storage devices. In order for such a device to produce a nanosecond-type pulse, its photoconductive switch must have the ability to transition from a high resistivity state to a conductive state in a sub-nanosecond time interval. One such switch, disclosed in U.S. Pat. No. 5,028,971, issued to Anderson H. Kim et al on Jul. 2, 1991, entitled, "High Power Photoconductor Bulk GaAs Switch" is incorporated herein by reference.

This GaAs switch is comprised of two, mutually opposite, gridded electrodes separated by a GaAs substrate capable of electrical energy storage. The stored energy can be photoconductively discharged when it receives laser light. More specifically, when the laser light is applied to the semiconductor material, electron hole pairs are generated in the substrate, thus causing the electrical resistance of the semiconductor material to instantaneously decrease. This instantaneous resistance change causes the stored energy to convert into discharge current and flow through an output circuit such that an RF pulse is radiated in a direction perpendicular to the substrate.

It is widely recognized that the shorter the RF radiator's pulsewidth becomes, the wider its radiation bandwidth will be. Hence, the faster the radiated pulse's rise time becomes, the wider the radiation bandwidth will be. Consequently, it has become very desirable for those skilled in the art to construct devices capable of generating pulses having faster and faster rise-times so that the radiation bandwidth can be extended further and further.

The critical element in generating such fast rise time, high voltage pulses is the energy storage device itself. Heretofore, there are two general energy storage techniques used to generate faster rise-time, high power pulses.

The first technique is to create a device that utilize the recombination property of semiconductor material. It has been determined, however, that such semiconductor materials exhibit a slow switch recovery time at high voltages. The long recovery time has been attributed to both the switch lock-on phenomena and the substantially long recombination time attributable to gallium arsenide. Hence, devices utilizing this storage technique are not desirable for the many wideband applications that require such high power pulses.

The second technique utilizes an energy storage element comprised of either a short section of transmission line or a capacitor that can be photoconductively triggered to instantaneously discharge all, or substantially all, of its stored energy to a load. As with the aforementioned technique, the extended recovery time inherent in a device utilizing such a photoconductive switch prevents this device from producing extended wideband radiation.

A major breakthrough in the generation of narrow pulses, however, was disclosed in the inventors U.S. Pat. No. 5,227,621 entitled "Ultra-Wideband High Power Photon Triggered Frequency Independent Radiator," issued to Kim et al. Jul. 13, 1993 and incorporated herein by reference. As disclosed, this frequency-independent radiator combines energy storage and antenna radiating functions into one structure to create an ultra-wideband frequency radiator capable of generating pulses with a range of frequency components from hundreds of megahertz to several gigahertz. Basically, this radiator utilizes two identical quasi-radial transmission line structures to store electric energy while it simultaneously implements photoconductive switching to trigger the instantaneous discharge of the stored energy to generate the desired ultra-wideband RF radiation.

Such an energy storage device comprises a dielectric storage medium, two quasi-radially shaped, metalized electrodes mounted opposite one another on the top surface of the dielectric storage medium, and a metalized electrode mounted on the bottom surface of the dielectric medium. The two quasi-radial shaped electrodes are connected to the bottom electrode via a photoconductive switch centrally located on the dielectric. When the switch is activated by laser radiation, the stored energy discharges through a predetermined load such that a sub-nanosecond type pulse is generated.

Those skilled in the art have recognized that the shape and overall geometry of the device directly affects the width of the discharged pulse, and thus its bandwidth. Specifically, the shape of the electrodes, the position of the energy storage elements, and the position of the photoconductive switches, directly affect the charging and discharging characteristics of the stored energy.

It has also been recognized that the gap distance between the electrodes directly affects the bandwidth of the radiated pulse. The narrower the gap the greater the radiated bandwidth. If the gap is made too small, however, device flashover, and thus device breakdown, may occur. Consequently, device efficiency is directly limited by the geometry of the storage element.

A radiator incorporating a storage element with an innovative geometry to achieve an even greater bandwidth than the prior art was disclosed in the inventor's co-pending application entitled "Ultra-wideband High Power Photon Triggered Frequency Independent Radiator With Equiangular Spiral Antenna," Ser. No 08/064,525, and incorporated herein by reference. This device utilized an equiangular spiral antenna electrode (in place of the quasi-radial transmission line disclosed above) positioned on the surface of a photoconductive semiconductor substrate. The spiral antenna electrode was positioned such that it could store high power electrical energy to be instantaneously discharged upon photon triggering. Consequently, the energy storage and energy radiation functions are performed in the same section of the device (i.e. spiral antenna). The result is a device that radiates RF energy at a much wider bandwidth than previously disclosed without compromising the radiated field strength.

Although RF generators utilizing such a device geometry can radiate energy having increased bandwidth and improved performance over existing devices, those skilled in the art still desire and recognize the need for Rf generators utilizing new and innovative geometric shapes and schemes that provide for even greater device performance and efficiency while not adding to the device's overall size or cost.

SUMMARY OF THE INVENTION

Accordingly, this invention provides a photon triggered ultra-wideband RF radiator having enhanced performance, improved operating efficiency, and thus improved overall effectiveness over those previously disclosed. To attain this, the present invention provides an RF radiator having geometrically and physically separated energy storage and energy radiation sections that efficiently store and discharge electrical energy such that a narrow output pulse of nanosecond pulsewidth dimension is radiated.

More specifically, an antenna or radiating electrode and an energy storage or charging electrode are positioned on a surface of a photoconductive dielectric substrate such that energy stored on the charging electrode can instantaneously discharge through the radiating electrode upon the application of a predetermined type of light energy directed at the region separating the energy storage and energy radiating electrode on the photoconductive substrate. The instantaneous discharge causes a narrow output pulse of nanosecond pulsewidth dimension to radiate from the radiating electrode. As a result, the geometric decoupling of the energy storage and radiator functions increases the radiation bandwidth, and thus enables the device to radiate more like an ideal frequency independent antenna.

In a preferred embodiment, the RF radiator structure is composed of a photoconductive semiconductor substrate having a bottom surface with a ground plane electrode positioned thereon, and having a top surface with a radiating or spiral antenna electrode and a pair of energy storage or charging pad electrodes positioned thereon. The spiral antenna electrode, composed two equiangular spiral antenna arms, is separated from the charging pads by a predetermined gap distance that is large enough to prevent surface flashover between the charging pads and the spiral arms but close enough to maximize the discharge of energy stored on the charging pads through the spiral antenna arms. The ground plane electrode is positioned on the bottom surface of the substrate such that only the charging pad electrodes on the top surface have a ground plane directly beneath it.

This configuration, in effect, allows the RF radiator to store energy on the charging pads such that when a predetermined light energy is applied to the photoconductive substrate, the stored energy can efficiently instantaneously discharge through the spiral antenna, thus radiating a pulse of nanosecond pulsewidth dimension from the substrate. Although the absence of ground plane electrode beneath the spiral antenna may cause a substantial decrease in the storage capability of the RF radiator structure, the overall radiation efficiency is increased due to the proximity of the charging pads with respect to the spiral antenna.

The separation of the energy storage and the radiator functions provides for a radiated bandwidth wider than that achieved by devices having both functions combined into the same section of the device, as in the prior art. Consequently, an RF radiator employing a geometry that separates these functions, increases the device's effectiveness over the aforementioned applications and prior art.

These and other features of the invention are described in more complete detail in the following description of the preferred embodiment when taken with the drawings. The scope of the invention, however, is limited only by the claims appended hereto.

DESCRIPTION OF THE PREFERRED EMBODIMENT

Figure 1:
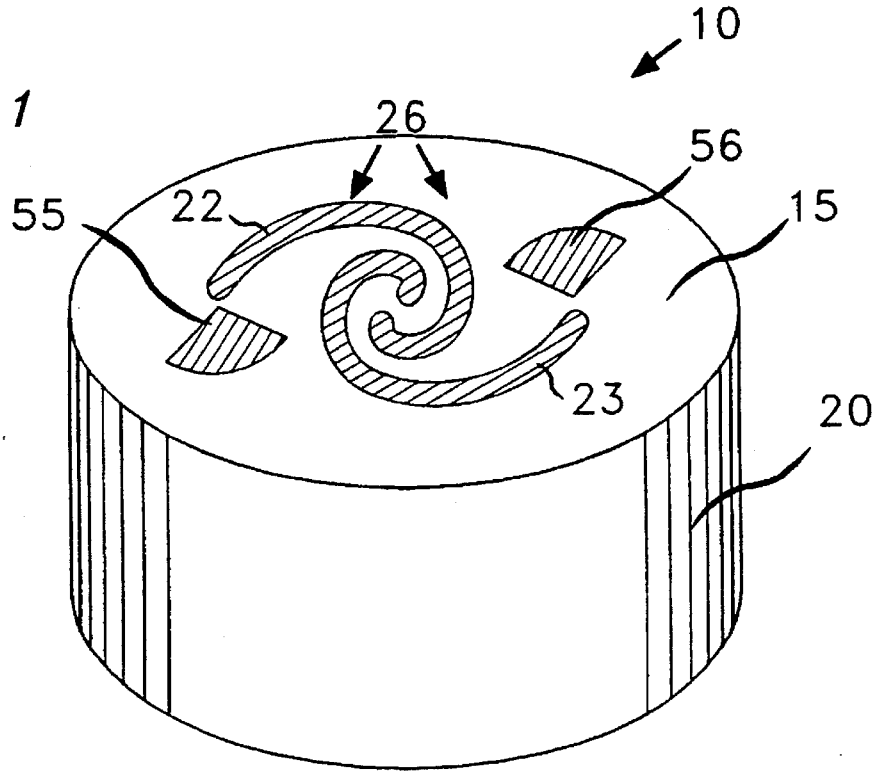
FIG. 1 is a side pictorial view of the preferred embodiment of the invention.
Figure 2:
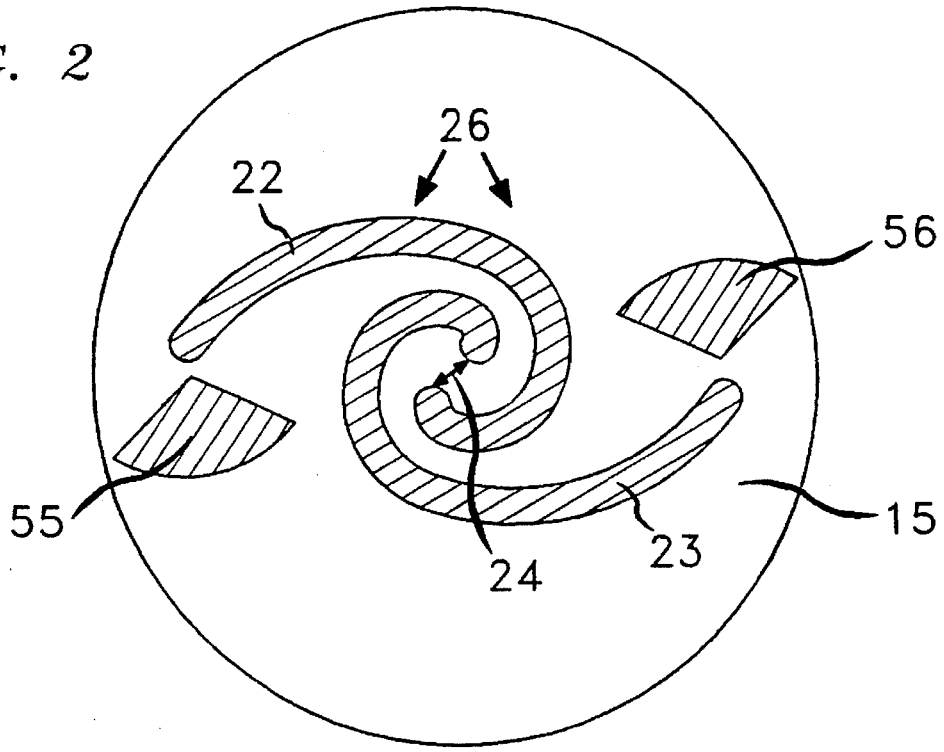
FIG. 2 is a top pictorial view of the upper surface electrode of the preferred embodiment in FIG. 1.

Referring now to the drawings there is shown in FIG. 1 a side pictorial view of preferred embodiment 10. As shown, top surface 15 of photoconductive dielectric substrate 20 has top surface electrode 26 composed of inner electrode spiral arms or spiral arms 22 and 23, and outer electrode charging pads or charging pads 55 and 56. Spiral arms 22 and 23 are separated by predetermined spiral gap 24, see FIG. 2, whose size directly affects the radiation bandwidth of device 10. Basically, the narrower the gap 24, the greater the radiation bandwidth.

Figure 3:
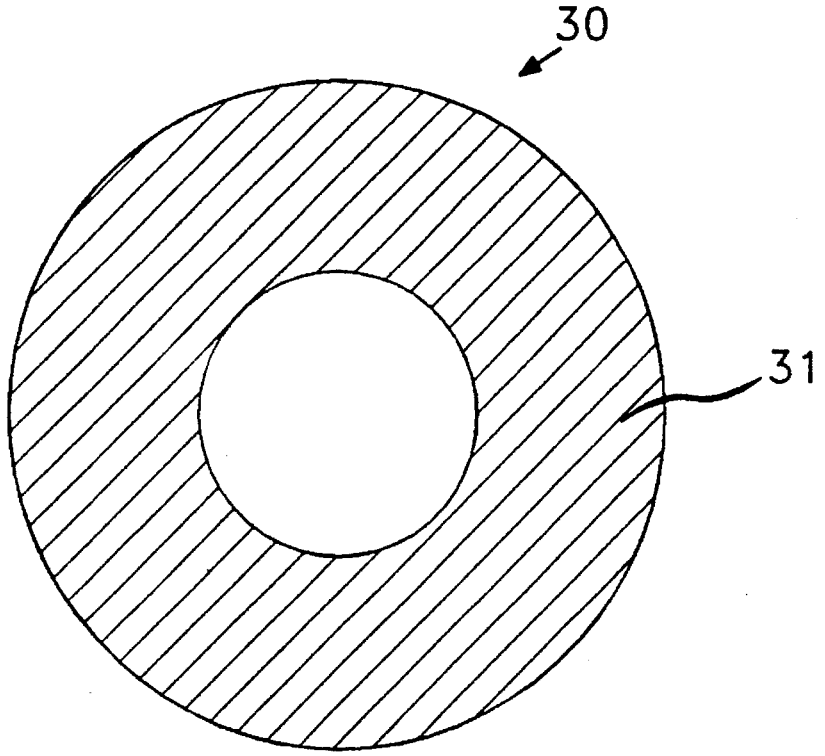
FIG. 3 is a bottom pictorial view of the annular ground plane of the preferred embodiment in FIG. 1.

In FIG. 3, there is shown bottom surface 30 having annular ground plane electrode or ground plane 31 positioned thereon directly beneath charging pads 55 and 56 such that spiral arms 22 and 23 have no portion of ground plane 31 directly beneath them. This configuration allows electrical energy to be stored on charging pads 55 and 56, and discharged through spiral arms 22 and 23. As a result, the energy storage and energy radiation functions are separated on top surface electrode 26, thus increasing the radiation efficiency of the device.

Operating the device involves alternately charging the charging pads 55 and 56 to voltages of different polarity and equal magnitude (+Vo and −Vo) relative to the ground plane, and then photoconductively triggering their discharge by directing a pulsed beam of laser light, having the correct frequency to cause conduction, at top surface 15 of photoconductive substrate 20. This immediately changes the electromagnetic boundary condition of substrate 20 between charging pads 55 and 56, and inner spiral antenna arms 22 and 23. As a result, the electrostatic energy stored in charging pads 55 and 56 discharges through spiral arms 22 and 23 causing travelling waves to flow toward the center of substrate 20 which, in turn, causes electromagnetic energy of nanosecond pulsewidth direction to radiate into free space.

Although the absence of ground plane electrode beneath the spiral antenna electrode may cause a substantial decrease in the storage capability of the RF radiator structure, the overall radiation efficiency is increased due to the proximity of the charging pads with respect to the spiral antenna. In addition, the separation of the energy storage and the radiator functions provides for a radiated bandwidth wider than that achieved by devices having both functions combined into the same section of the device, as in the prior art. Consequently, an RF radiator employing a geometry that separates these functions, increases the device's effectiveness over the aforementioned prior art.

What is claimed is:

1. An ultra-wideband RF radiator, comprising:

a photoconductive dielectric substrate having an upper and a lower surface;

a charging electrode for storing a predetermined amount of electrical energy, said charging electrode positioned on said upper surface of said photoconductive substrate;

a ground plane electrode positioned on said lower surface of said photoconductive dielectric substrate, said ground plane electrode covering said lower surface of said substrate only in areas directly beneath said charging electrode to enable said charging electrode to store said predetermined amount of electrical energy; and a radiating electrode for radiating a pulse of nanosecond pulsewidth dimension, said radiating electrode positioned on said upper surface of said photoconductive dielectric substrate, said radiating electrode and said charging electrode separated by a predetermined gap distance to prevent surface flashover between said charging electrode and said radiating electrode, and to enable said predetermined amount of electrical energy stored on said charging electrode to efficiently discharge through said radiating electrode upon an application of a predetermined type of light energy such that said pulse of nanosecond pulsewidth dimension radiates from said radiating electrode.

said charging electrode is comprised of a plurality of charging pads, said charging pads positioned in an outer annular region of said upper surface of said photoconductive substrate, said radiating electrode is comprised of a spiral antenna having equiangular spiral arms, said spiral antenna positioned in a center region of said upper surface of said photoconductive substrate.

2. The ultra wideband RF radiator of claim 1 wherein said photoconductive dielectric substrate is comprised of GaAs.

* * * * *